United States Patent [19]

Libby

[11] Patent Number: 5,007,618

[45] Date of Patent: Apr. 16, 1991

[54] STANDING AND WALK STARTING APPARATUS

[76] Inventor: Fred G. Libby, R.D. #1 Box 508E, Mays Landing, N.J. 08330

[21] Appl. No.: 481,431

[22] Filed: Feb. 20, 1990

[51] Int. Cl.[5] ..... E04H 17/00

[52] U.S. Cl. ..... 256/1; 256/59; 135/65; 297/DIG. 10; 4/254

[58] Field of Search ..... 135/67, 65; 4/254; 297/217, DIG. 10; 5/81 R; 256/1, 59

[56] References Cited

U.S. PATENT DOCUMENTS

| | | | |
|---|---|---|---|
| D. 179,394 | 12/1956 | Mills . | |
| 1,067,767 | 7/1913 | Simonson . | |
| 1,781,938 | 11/1930 | Zundel . | |
| 2,113,882 | 4/1938 | Galt . | |
| 2,642,117 | 6/1953 | Glauber | 155/1 |
| 2,773,542 | 12/1956 | Chasin | 4/254 |
| 3,591,874 | 7/1971 | O'Kennedy | 135/67 X |
| 4,343,052 | 8/1982 | Guenther . | |
| 4,498,204 | 2/1985 | Warner . | |
| 4,844,107 | 7/1989 | Watkins | 135/67 X |
| 4,894,871 | 1/1990 | Schmerler | 4/254 |

FOREIGN PATENT DOCUMENTS

| | | | |
|---|---|---|---|
| 448772 | 5/1948 | Canada . | |
| 842141 | 6/1939 | France | 4/254 |
| 1050656 | 4/1982 | U.S.S.R. . | |

*Primary Examiner*—John E. Murtagh
*Assistant Examiner*—Lan Mai
*Attorney, Agent, or Firm*—Thomas A. Lennox

[57] ABSTRACT

A device to aid a person to stand up from a sitting position on a chair or the seat of a water closet is provided with a base panel that is cut out to interfit around the base of the water closet or support and hold an easy chair. Horizontal stop members in the form of a vertical hole through a block are attached on the top of the panel to receive the bottom ends of chair legs sitting on the top of the base panel. Two members, one on each side of the chair, inclined upwardly past the front of the chair, are attached to the base panel and supported at the front ends. A front section of the inclined member is a cantilever section to be gripped by the hands to facilitate rising from the chair. Rails are structurally attached to the inclined members extending forwardly proximate and below the front ends of the inclined members to allow the person to rise up, rest his or her hands on the rail members and begin walking away from the chair or seat.

18 Claims, 2 Drawing Sheets

STANDING AND WALK STARTING APPARATUS

BACKGROUND OF THE INVENTION

This invention involves a device to aid persons to stand from a sitting position and to begin walking.

Most older infirm persons wish to continue to be on their own and not depend on another person's continuing physical aid as much as possible. However, the difficulty in rising up from a sitting position and beginning to walk to another location in the home defeats the desire for independence for many older persons. In many cases, the older infirm person is of limited strength and does not have the leg and back strength necessary to rise from a sitting position. The difficulty is particularly apparent when the person is attempting to rise up from the lower height of the seat of a water closet or from a soft comfortable chair, which allows the person to sink into it. Thus, while the older infirm person would enjoy the comfortable chair, it is the very nature of that chair that makes getting out of it more difficult and thus unsatisfactory for use, unless there is another person to aid the infirm person in rising from the chair.

There are a number of mechanical devices which, if made part of the chair, tilt and aid the person in rising. These devices are not practical for the water closet seat and are expensive mechanical devices that require maintenance and upkeep. Further, tilting the chair can cause the person to lose balance as he or she is raised up to a near standing position. Attaching rails to the wall in the bathroom are permanent and unattractive. None of the other devices in the prior art satisfy the needs described above, nor attain the objects provided hereinbelow.

SUMMARY OF THE INVENTION

It is observed that older infirm persons, even if they are suffering from arthritis or other bone deteriorating illnesses, still retain a substantial amount of strength, particularly in the major arm muscles. Further, it is observed that a certain amount of exercise and use of the muscles retains muscle tone and strength. Thus, a purely mechanical device to aid the infirm has undesirable side effects. In particular, it has been found that many older infirm persons are quite capable of pulling backwardly and downwardly with their arms and shoulders as these are the muscles that are used to support the person as they attempt to rise or hold themselves on a walker, cane or like implement. Thus, the device of the present invention utilizes the pulling power and the remaining strength of the person to grip ends of two angled members which are positioned in front of and slightly above the seated person. By gripping the ends of these angled members and pulling rearwardly and downwardly, the infirm person is usually quite capable of easily rising from the sitting position.

It is an object of the present invention to provide a standing and walk starting apparatus which can be positioned at a water closet or with a favorite chair to allow a person to rise up under his or her own power without the aid of another person.

It is a further object of the present invention to provide a device that not only aids the person to rise, but also provides initial support to aid the person to balance and begin the walking process.

It is a particular object of the present invention to provide a device that utilizes the person's remaining strength and power to pull downwardly and rearwardly against a pair of suitably positioned gripping members to aid the person in rising from the seat.

It is an additional object of the present invention to provide a device to aid the person to rise from the seat and allow the person to not only stand in front of the seat to gain his or her balance but also to take the first steps with supporting rails to aid in those first hesitate steps.

It is an additional object of the present invention to provide a device on which a favorite attractive chair may be positioned with the feet of the chair being positionable such that the rear feet are raised slightly, thus tilting the chair seat forwardly to further facilitate and aid the person in rising from the chair.

It is an additional object of the present invention to provide a device that cannot move despite the substantial stress placed on the device to aid the person in rising from the chair as well as against the seat without allowing movement of either the device or the seat.

It is an additional object of the present invention to provide a device that does not alter or modify the seat in any way and operates independently of seat structure.

The invention is a device to aid a person to stand up from a sitting position on a seat and to start walking. The devise includes a floor base panel that includes a rear portion positionable proximate the rear of the seat, two side portions, one on each side of the seat, and a front portion of an area sufficient to allow the person to stand on in front of the seat. The device further includes a pair of inclined members, one each over opposite side portions, each inclined member includes a rear end attached proximate the rear portion of the base panel, and a length and angle of inclination upwardly from the rear to the front sufficient to position a front end of each inclined member at a height and horizontal position to allow the person to grasp the ends to pull downwardly and rearwardly against the ends to aid in rising from the seat. The device also includes support means attached between the side portions of the base panel and the inclined members to vertically support the inclined members, and stability means to prevent horizontal movement of the base panel relative to the seat.

It is preferred that the device further include a pair of rail devices, each including a horizontal rail attached on a rear end to the support means at a height allowing the front end of the inclined member to extend over the horizontal rails, and support means attached to the front portion of the base panel and to the horizontal rail to support the horizontal rail, wherein the horizontal rails extend lengthwise frontwardly from the seat over the two side portions. It is also preferred that the stability means include a cut out opening in the base panel to a central section of the rear portion of sufficient size to fit around a base of a bathroom water closet and allow the rear portion to rest against a wall behind the water closet. It is further preferred that the stability means include chair leg holding means attached on the base panel to allow engagement of the bottom of the chair legs and to prevent horizontal movement of the legs relative to the base panel. It is also preferred that the stability means include raised members at a higher height than the base panel attached on the rear portion of the base panel and chair leg holding means on the raised members, wherein the height of the raised members is sufficient to raise the rear legs of a chair resting in the chair leg holding means and angle the seat forwardly. It is further preferred that the stability means include at least two chair leg holding means including members with vertical holes sufficient in size and shape to receive the bottom ends of the chair legs.

DESCRIPTION OF PREFERRED EMBODIMENTS

Figure 1:
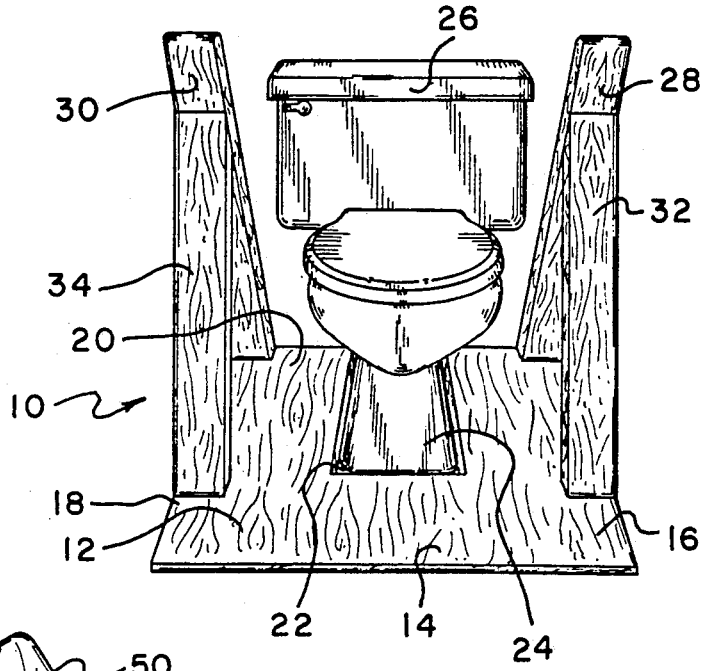
FIG. 1 is a perspective view of a water closet with a device of the present invention positioned around the water closet.
Figure 2:
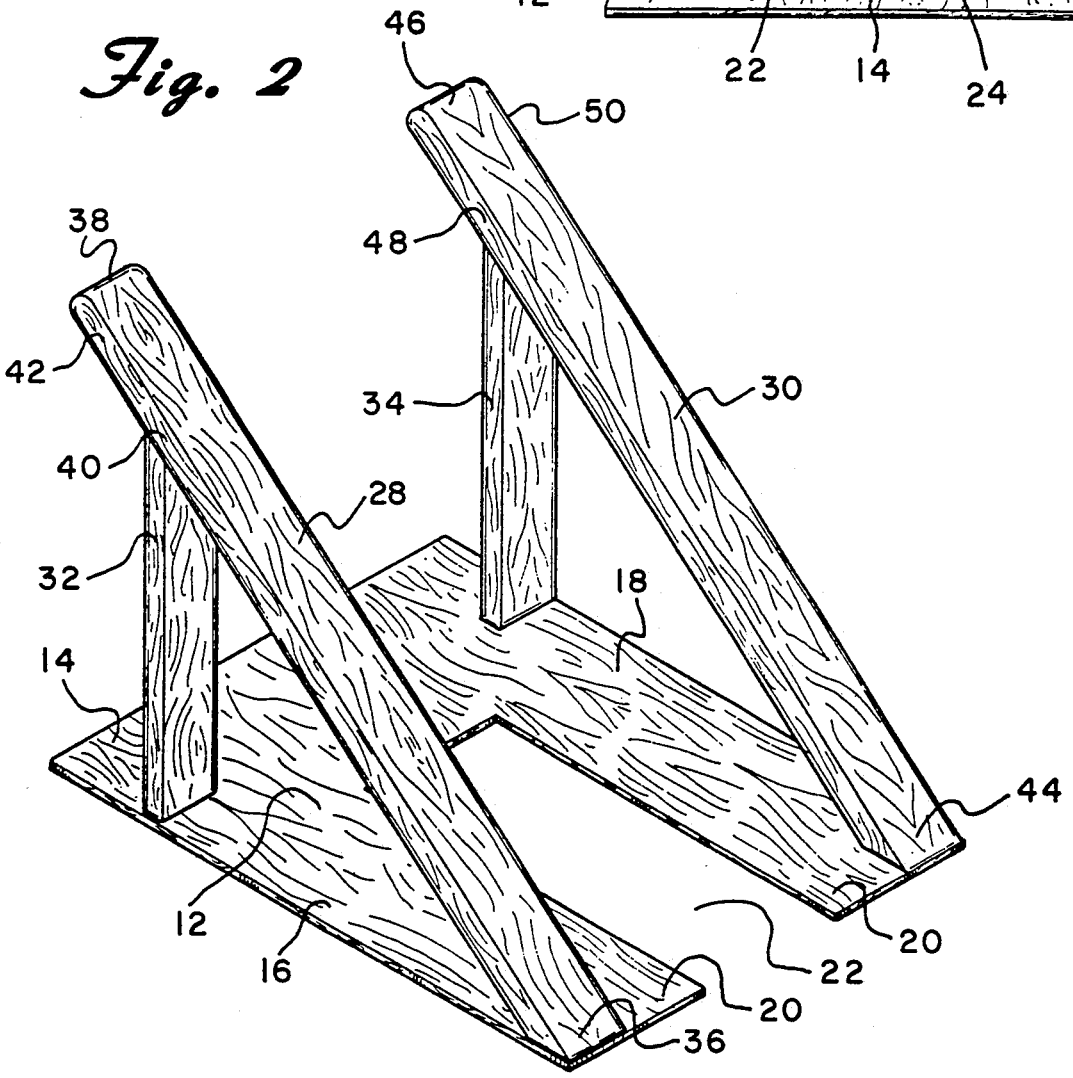
FIG. 2 is an enlarged perspective view of the device illustrated in FIG. 1.

Device 10 to aid a person to stand up from a sitting position on water closet 26 is illustrated in FIG. 1. Base floor panel 12 rests on the floor and includes front section 14, left side section 16, right section 18 and rear section 20. Rectangular cut out 22 is cut out centrally, opening to rear section 20 of sufficient size and shape to interfit around base 24 of water closet 26. The size of cut out 22 provides a snug fit around base 24 to essentially prevent horizontal movement side to side and to place rear section 20 against a rear wall behind water closet 26 to prevent rearward movement of panel 12. Inclined members 28 and 30 as further illustrated in FIG. 2 are inclined an angle of about 40 degrees from the horizontal, preferably positioned at an angle of about 25 to 60 degrees from the horizontal. Left inclined member 28 is structurally attached at rear end 36 to section 20 of base panel 12 proximate side section 16. Member 28 is supported by vertical support member 32 structurally attached at the bottom to base panel 12 proximate left edge section 16 and forward of the position of attachment of lower end 36 of left inclined member 28. Support member 32 is structurally attached to the bottom surface of left inclined member 28 at an intermediate position rearwardly of upper and front end 38 of left inclined member 28. This position 40 along the length of left inclined member 28 is chosen to provide sufficient vertical support for inclined member 28 and also to allow section 42 of inclined member 28 to extend unsupported frontwardly past the upper end of vertical support member 32. This allows the person's left hand, specifically the fingers, to extend downwardly and rearwardly around front end 38 to allow maximum purchase grip and power to be exerted in the lifting and pulling process. By positioning support member 32 rearwardly, unsupported end section 42 allows the person's fingers to extend downwardly on the bottom surface. Right inclined member 30 is essentially identical to left inclined member and right support member 34 is essentially identical to left support member 32. Member 30 is structurally attached to rear section 20 proximate right side section 18 and right support member is structurally attached to right side section 18 forwardly of rear section 20, but set back from the front edge of front section 14. Support member 34 is positioned vertically and is structurally attached to the bottom surface of median section 48 of member 30 leaving front end section 50 of member 30 extending forwardly as a cantilever section. Member 30 terminates at the front top end 46 which is gripped by the right hand of the person seeking to rise up exerting force downwardly and rearwardly to facilitate rising from the chair. Base panel 12 is constructed of a ½ inch thick plywood panel, 30 inches wide and about 40 inches long, measured front to rear. For most water closets, a cut out 26 inches long and 10 inches wide is sufficient to allow the panel to interfit around the base of the water closet. For best purchase power, it is preferred that the front top ends 38 and 46 be positioned about 32 inches about the floor.

Figure 3:
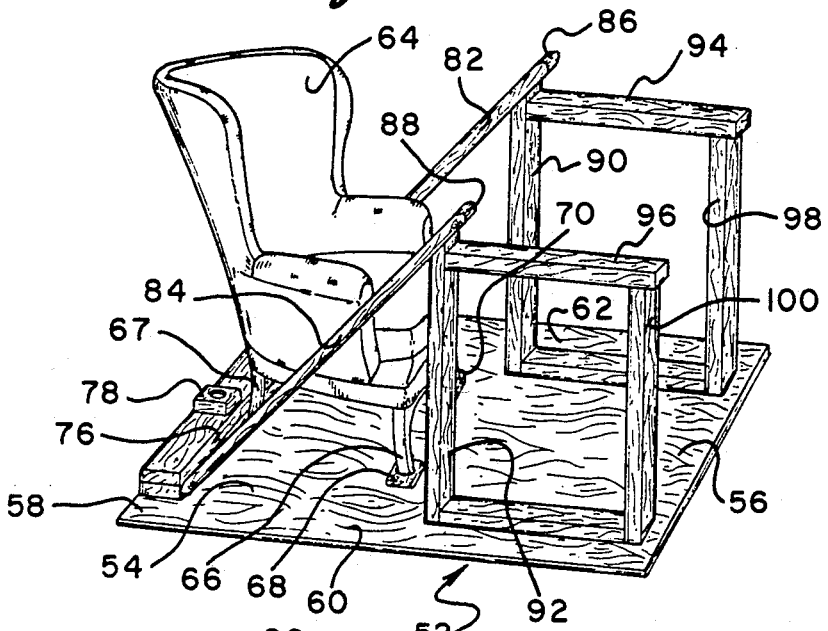
FIG. 3 is a perspective view of a second embodiment of the present invention with a chair positioned on the device.
Figure 4:
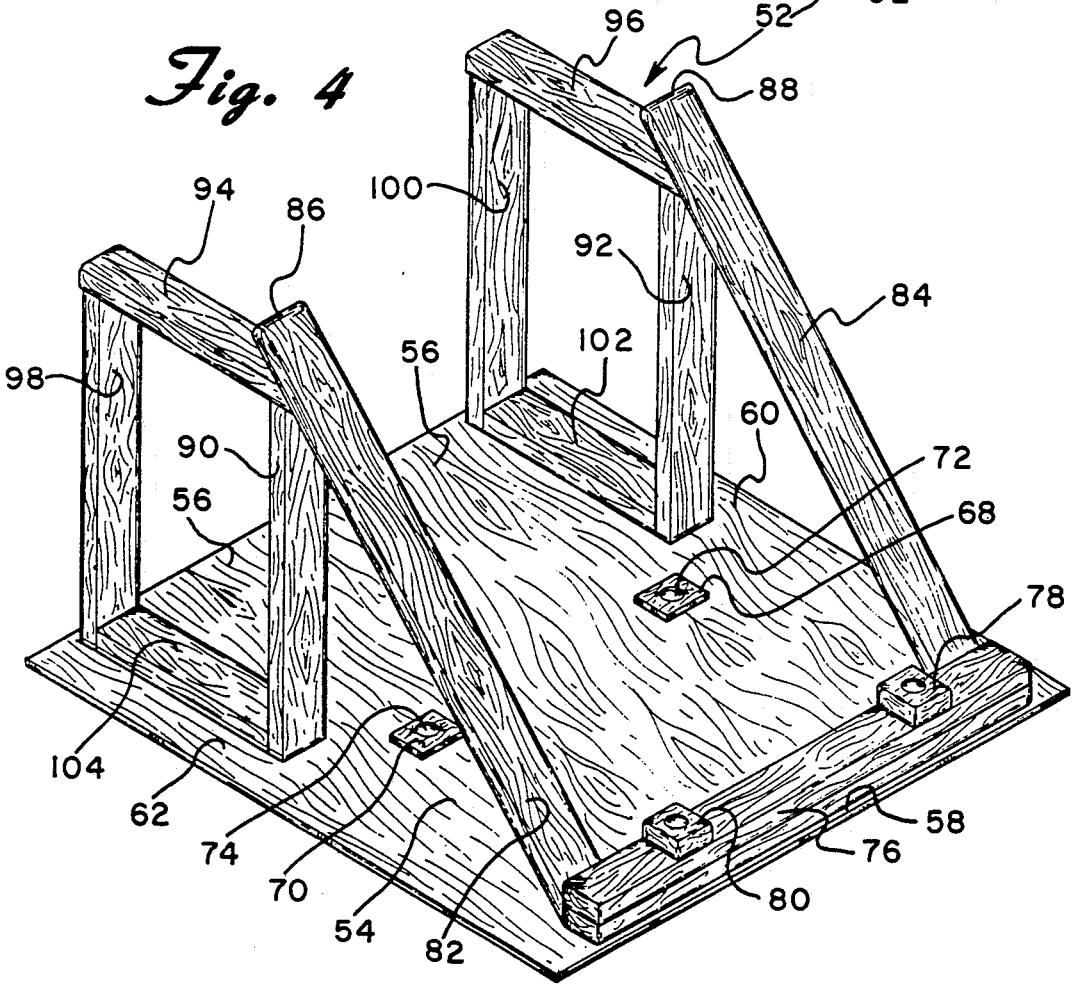
FIG. 4 is an enlarged perspective view of the device illustrated in FIG. 3 looking from the opposite direction.

In FIGS. 3 and 4 device 52 is illustrated wherein chair 64, supported on front legs 66 and rear legs 67, is shown resting on floor base panel 54 of the device. Panel 54 includes front section 56, rear section 58, right side section 60, and left side section 62. Panel 54 is about 48 inches wide and about 50 inches front to rear. Front legs 66 also rest in right front leg stability lock 68 and left front leg stability lock 70 which are both attached to the upper surface of panel 54 with two-sided adhesive tape or like attachment means. Rear legs 67 of chair 64 rest on the top surface of panel 54 proximate rear section 58 in front of rear board stop 76 which is structurally attached to panel 54 along rear edge section 58. Thus, when chair 64 is in the position as illustrated, the chair cannot move horizontally and in particular cannot move rearwardly as the person attempts to rise from the seat and exerts any pressure on the chair to the rear. A second position for the chair is to position rear legs 67 in right rear leg stability lock 78 and left rear leg stability lock 80, both positioned on the top of rear board stop 76 about 2 inches above panel 54. In this position, the chair is tilted slightly forwardly to further aid a person from rising from the chair. Front legs 66 rest on panel 54 immediately behind and abutting chair leg locks 68 and 70. As more particularly shown in FIG. 4, stability locks 68, 70, 78, and 80 are square blocks of wood about ½ to 1 inch thick with a centrally located vertical hole extending downwardly through the block of a size and shape to receive the bottom ends of the chair legs to prevent horizontal movement of the legs when engaged in the holes. Specifically, holes 72 and 74 are cut out of stops 68 and 70 to provide a horizontal lock for front legs 66 of chair 64. In a structure similar to that of device 10, left inclined member 82 and right inclined member 84 are structurally supported and inclined at about a 55 degree angle from the horizontal. Members 82 and 84 are structurally attached at their rear lower ends to panel 54 proximate rear section 58 and in front of rear board stop 76. Members 82 and 84 are supported at their front sections by left vertical support members 90 and 92 respectively. Again, left support member 90 is attached to the bottom surface of member 82 rearwardly of front end 86 allowing the end section to extend unsupported as a cantilever member to allow maximum gripping area under the front end section of member 82. Likewise, right vertical support member 92 is attached to the bottom surface of member 84 rearwardly of front end 88 to allow the front end section to extend unsupported as a cantilever member. In this embodiment, left rail member 94 is structurally attached to the frontwardly facing surface of vertical left support member 90 extending horizontally frontwardly to be supported from below by left front rail support member 98. The length of vertical support member 98 is chosen to position the height of left rail 94 well below the front end 86 of member 82. In this embodiment, a left rail member, as well as right rail member 96 structured and supported similarly, is positioned about 32 inches above floor panel 54 while end 86 is located about 34 inches above ground level. This two inch distance between rail 96 and end 86 allows sufficient space for the hands to grip under the ends of the inclined members without encountering the top of rail 96. Right rail member is horizontally supported by attachement to vertical right support member 92 and is supported from below by vertical right front rail support member 100. The relative height of right rail 96 with respect to front end 88 of inclined member 84 is the same as that of left rail 94. The distance between inclined members 82 and 84 as well as the distance between horizontal rails 94 and 96 is about 28 to 31 inches. Structural support members may be included to provide added support for the vertical support members. In this embodiment, bottom horizontal support member 102 is structurally attached between the bottom ends of members 92 and 100 on the top surface of panel 54 while lower horizontal support member 104 is structurally attached between the bottom ends of vertical support members 90 and 98 on the top surface of panel 54 to provide additional structural support.

In the embodiments illustrated in FIGS. 1 through 4, the base panels are constructed of ½ inch plywood, the support members and rails are constructed of 2×4 lumber, and the inclined members and rear board stops are constructed of 1×4 lumber. It is preferred that the inclined members be constructed of wood a full 1 inch thick while the balance of the structural members are of nominal sizes.

When utilizing device 52, the person sitting in chair 64 grips the top front ends 86 and 88 of inclined members 82 and 84 exerting force rearwardly and downwardly to rise out of the chair. When the person has risen to a standing position, the person transfers first one hand and then the other hand to horizontal rails 94 and 96. The person can then take the first few steps walking on base panel 54 while being supported by rails 94 and 96. By the time the person has reached the end of rails 94 and 96 and is ready to step off of panel 54, the person has usually gained full balance and confidence and is ready to walk either unaided or with the aid of a walker to his or her destination. A walker may be positioned in front of section 56 of panel 54 or the person's cane may be hooked over one of the rails ready for use at the end of the rails.

While this invention has been described with reference to the specific embodiments disclosed herein, it is not confined to the details set forth and the patent is intended to include modifications and changes which may come within and extend from the following claims.

I claim:

1. A device to aid a person to stand up from a sitting position on a seat and to start walking, the device comprising:

(a) a floor base panel comprising:
  (i) a rear portion positionable proximate the rear of the seat.
  (ii) two side portions, one on each side of the seat, and
  (iii) a front portion of an area sufficient to allow the person to stand on in front of the seat, (b) a pair of inclined members, one each over opposite side portions, each comprising:
  (i) a rear end attached proximate the rear portion of the base panel, and
  (ii) a length and angle of inclination of about twenty-five to about sixty degrees upwardly from the rear to the front sufficient to position a front end of each inclined member at a height and horizontal position to allow the person to grasp the front ends to pull with the person's handsdownwardly and rearwardly against the front ends to aid in rising from the seat.

(c) support means attached between the side portions of the base panel and the inclined members to vertically support the inclined members, and (d) stability means to prevent horizontal movement of the base panel relative to the seat.

2. The device of claim 1 further comprising a pair of rail devices, each comprising:

(a) a horizontal rail attached on a rear end to the support means at a height allowing the front end of the inclined member to extend over the horizontal rail, and (b) support means attached to the front portion of the base panel and to the horizontal rail to support the horizontal rail, wherein the horizontal rails extend lengthwise frontwardly from the seat over the two side portions.

3. The device of claim 1 wherein the stability means comprises a cut out of the base panel opening to a central section of the rear portion of sufficient size to fit around a base of a bathroom water closet and rest against a wall behind the water closet.

4. The device of claim 1 wherein the stability means comprises chair leg holding means attached on the base panel to allow engagement of the bottom of chair legs of a chair resting on the base panel and to prevent horizontal movement of the legs relative to the base panel.

5. The device of claim 4 wherein the stability means comprises at least two chair leg holding means comprising members with vertical holes sufficient in size and shape to receive the bottom ends of the chair legs.

6. The device of claim 1 wherein the stability means comprises raised members at a higher height than the base panel attached on the rear portion of the base panel and chair leg holding means on the raised members, wherein the height of the raised members is sufficient to raise the rear legs of a chair resting in the chair leg holding means and angle the seat forwardly.

7. The device of claim 1 wherein the front ends of the inclined members are supported about thirty-two inches above the base panel.

8. A device to aid a person to stand up from a sitting position on a seat and to start walking, the device comprising:

(a) a floor base panel comprising:
  (i) a rear portion positionable proximate the rear of the seat,
  (ii) two side portions, one on each side of the seat, and
  (iii) a front portion of an area sufficient to allow the person to stand on in front of the seat, (b) a pair of inclined members, one each over opposite side portions, each comprising:
  (i) a rear end attached proximate the rear portion of the base panel, and
  (ii) a length and angle of inclination upwardly from the rear to the front sufficient to position a front end of each inclined member at a height and horizontal position to allow the person to grasp the front ends to pull with the person's hands downwardly and rearwardly against the front ends to aid rising from the seat, (c) support means attached between the side portions of the base panel and the inclined members to vertically support the inclined members, (d) a pair of rail devices, each comprising:

(i) a horizontal rail attached on a rear end to the support means at a height allowing the front end of the inclined member to extend over the horizontal rail, and (ii) support means attached to the front portion of the base panel and to the horizontal rail to support the horizontal rail, wherein the horizontal rails extend lengthwise frontwardly from the seat over the two side portions, and (e) stability means to prevent horizontal movement of the base panel relative to the seat.

9. The device of claim 8 wherein the stability means comprises chair leg holding means attached on the base panel to allow engagement of the bottom of the chair legs and to prevent horizontal movement of the legs relative to the base panel.

10. The device of claim 9 whrein the stability means comprises at least two chair leg holding means comprising members with vertical holes sufficient in size and shape to receive the bottom ends of the chair legs.

11. The device of claim 8 whrein the stability means comprises raised members at a higher height than the base panel attached on the rear portion of the base panel and chair leg holding means on the raised members, wherein the height of the raised members is sufficient to raise the rear legs of a chair resting in the chair leg holding means and angle the seat forwardly.

12. The device of claim 8 wherein the front ends of the inclined members are supported about thirty-two inches above the base panel.

13. A device to aid a person to stand up from a sitting position on a chair seat resting on legs and to start walking, the device comprising:

(a) a floor base panel comprising:

(i) a rear portion positionable proximate the rear of the seat, (ii) two side portions, one on each side of the seat, and (iii) a front portion of an area sufficient to allow the person to stand on in front of the seat, (b) a pair of inclined members, one each over opposite side portions, each comprising:

(i) a rear end attached proximate the rear portion of the base panel, and (ii) a length and angle of inclination upwardly from the rear to the front sufficient to position a front end of each inclined member at a height and horizontal position to allow the person to grasp the front ends to pull with the person's hands-downwardly and rearwardly against the front ends to aid in rising from the seat, (c) support means attached between the side portions of the base panel and the inclined members to vertically support the inclined members, and (d) stability means to prevent horizontal movement of the base panel relative to the seat comprising chair leg holding means attached on the base panel to allow engagement of the bottom of the chair legs and to prevent horizontal movement of the legs relative to the base panel.

14. The device of claim 13 wherein the chair leg holding means comprise members with vertical holes sufficient in size and shape to receive the bottom ends of the chair legs.

15. The device of claim 13 wherein the stability means comprises raised members at a higher height than the base panel attached on the rear portion of the base panel and chair leg holding means on the raised members, wherein the height of the raised members is sufficient to raise the rear legs of a chair resting in the chair leg holding means and angle the seat forwardly.

16. A device to aid a person to stand up from a sitting position on a seat and to start walking, the device comprising:

(a) a floor base panel comprising:

(i) a rear portion positionable proximate the rear of the seat, (ii) two side portions, one on each side of the seat, and (iii) a front portion of an area sufficient to allow the person to stand on in front of the seat, (b) a pair of inclined members, one each over opposite side portions, each comprising:

(i) a rear end attached proximate the rear portion of the base panel, and (ii) a length and angle of inclination upwardly from the rear to the front sufficient to position a front end of each inclined member at a height and horizontal position to allow the person to grasp the front ends to pull with the person's hands-downwardly and rearwardly against the front ends to aid in rising from the seat, (c) support means attached between the side portions of the base panel and the inclined members to vertically support the inclined members, and (d) stability means to prevent horizontal movement of the base panel relative to the seat comprising raised members at a higher height than the base panel attached on the rear portion of the base panel and chair leg holding means on the raised members to allow engagement of the bottom of the chair legs and to prevent horizontal movement of the legs relative to the raised members, wherein the height of the raised members is sufficient to raise the rear legs of a chair resting in the chair leg holding means and angle the seat forwardly.

17. The device of claim 16 wherein the stability means further comprises additional chair leg holding means attached on the base panel to allow engagement of the bottom of the chair legs and to prevent horizontal movement of the legs relative to the base panel.

18. The device of claim 17 wherein the chair leg holding means comprise members with vertical holes sufficient in size and shape to receive the bottom ends of the chair legs.

* * * * *